United States Patent [19]

Hatch et al.

[11] 3,966,013

[45] June 29, 1976

[54] MULTI-PLY WOVEN ARTICLE HAVING ACOUSTICAL ELEMENTS BETWEEN DOUBLE PLIES

[75] Inventors: Donald M. Hatch, Huntington Beach; George D. Lee, Monterey Park, both of Calif.

[73] Assignee: Hitco, Irvine, Calif.

[22] Filed: Sept. 20, 1974

[21] Appl. No.: 507,771

Related U.S. Application Data

[63] Continuation of Ser. No. 290,542, Sept. 20, 1972, abandoned.

[52] U.S. Cl. ..... 181/33 G; 139/410; 428/116; 428/117; 428/119; 428/120; 428/188; 428/225; 428/257

[51] Int. Cl.[2] ..... F04B 1/99; G10K 11/04

[58] Field of Search ..... 181/33 G; 161/49, 72, 161/88, 98, 127, 68, 69; 139/384 R, 410; 428/116, 117, 119, 188, 120, 225, 255, 257

[56] References Cited

UNITED STATES PATENTS

| | | | |
|---|---|---|---|
| 3,090,406 | 5/1963 | Koppelman et al. | 139/410 |
| 3,481,427 | 12/1969 | Dobbs et al. | 181/50 |
| 3,538,957 | 11/1970 | Rheaume | 139/410 |
| 3,575,776 | 4/1971 | MacIntyre | 139/410 |

*Primary Examiner*—William J. Van Balen
*Assistant Examiner*—James J. Bell
*Attorney, Agent, or Firm*—Fraser and Bogucki

[57] ABSTRACT

A multi-ply woven article has elements positioned within pockets formed by double plies of the article to provide the article with desirable acoustical properties as well as considerable strength and rigidity. The double plies may comprise a generally parallel pair of rib plies which extend between the opposite faces of the article in generally zig zag fashion to form a plurality of intermediate rib portions, or a pair of generally parallel, spaced apart face plies forming each of the opposite faces of the article, or both. Some of the pockets formed by the double plies are filled with acoustical elements having a selected number of holes of appropriate size so as to pass sound waves therethrough at a controlled rate, while still other pockets are filled with non-acoustical elements which are generally impervious to sound waves. By appropriate location of the acoustical and non-acoustical elements the article is effectively provided with a plurality of chambers which trap and dissipate sound wave energy entering from outside the article.

6 Claims, 4 Drawing Figures

MULTI-PLY WOVEN ARTICLE HAVING ACOUSTICAL ELEMENTS BETWEEN DOUBLE PLIES

This is a continuation of application Ser. No. 290,542, filed Sept. 20, 1972, now abandoned.

BACKGROUND OF THE INVENTION

1. Field of the Invention

The present invention relates to woven fabric articles, and more particularly to multi-ply woven fabric acoustical panels of the type which have controlled porosities for admission of sound wave energy into compartments formed within the panel where the energy is dissipated.

2. History of the Prior Art

Three-dimensional, integrally woven fabrics have been found to provide the basic superstructure for acoustical panels of low cost capable of meeting the demands previously satisfied only by very expensive acoustical materials. In the field of aircraft design, for example, three-dimensional woven fabrics when resin impregnated for rigidity have been found to provide relatively inexpensive acoustical panels which can be mounted in critical areas of jet engines and other areas of the aircraft so as to absorb and dissipate substantial amounts of sound. Such acoustical panels typically have a plurality of internal ribs which are integrally woven with opposite faces so as to form compartments therein. At least one of the faces, and in some cases selected ones of the ribs, are provided with a plurality of apertures appropriately dimensioned and configured so as to admit and thereby trap sound waves within the compartments from outside the face.

The apertures within the various plies of the acoustical panel play a key role in its sound deadening capabilities. On the one hand at least one of the faces must be provided with a sufficient number of apertures of sufficient size so as to pass a considerable volume of sound waves to the inside compartments for dissipation. By the same token the faces and the other portions of the acoustical panel must have the necessary strength and rigidity so as to be useful for the particular applications in question.

A common problem in making a panel which is rigid strong and yet adequately apertured arises from the fact that the yarns used to weave the faces and interconnecting ribs of such fabrics undergo considerable flattening during weaving of the fabric and during subsequent resin impregnation thereof. Thus where the various faces and interconnecting ribs are comprised of single piles of the woven fabric, the fabric cannot be woven too loosely if it is to have a reasonable amount of strength, rigidity and structural integrity. By the same token weaving of the fabric in relatively dense fashion so as to provide such suitable properties is often accompanied by considerable difficulty in controlling the porosity of the woven fabric plies. With the fabric densely woven to begin with, the accompanying flattening of the yarns which occurs during weaving and during lay-up and cure often results in most or all of the apertures between adjacent yarns of the fabric being completely covered over with resin.

A number of techniques have been employed to enable the weaving of single ply faces and ribs so that they have both high density and the required amount of porosity. One such technique is disclosed in U.S. Pat. No. 3,481,427, Dobbs et al., issued Dec. 2, 1969. In the Dobbs et al patent at least one of the faces of the acoustical panel is woven of high-twist yarns. The high-twist condition of the yarns increases their density and thereby their resistance to flattening. In an alternative technique described in a copending application Ser. No. 268,475, filed July 3, 1972, Acoustical Panel, Leon Parker, now U.S. Pat. No. 3,756,346 which patent is commonly assigned with the present application, the critical areas of the acoustical panel are comprised of standard low-twist yarns having other low-twist yarns served or braided therein so as to greatly increase their resistance to flattening.

By employing techniques of the type referred to in the Dobbs, et al patent and in U.S. Pat. No. 3,756,346 it is usually possible to provide an acoustical panel which not only has the necessary acoustical properties but which has considerable strength and rigidity. However it may be desirable for certain applications to provide panels of this type having greatly increased strength and rigidity. Moreover for reasons such as cost or manufacturing technique it may be desirable to provide alternative techniques for making such panels. For example it would be advantageous in most instances to be able to greatly decrease the complexity, cost and time required for the weaving operation such as by being able to weave a relatively low density fabric, while at the same time providing the resulting acoustical panel with a selected, highly controlled porosity. It would also be desirable to be able to readily make certain portions of the woven fabric porous and other portions of the fabric non-porous in an effective and efficient manner, without the necessity for resorting to such techniques as variation in density during weaving or in the types of yarns used.

BRIEF SUMMARY OF THE INVENTION

Woven articles in accordance with the invention comprise woven fabrics having a plurality of plies which define the opposite generally planar faces and the intermediate and interconnecting ribs of an acoustical panel. At least two of the plies of the woven fabric are arranged in generally parallel, spaced apart relation so as to form a plurality of generally planar pockets therebetween. The pockets are adapted to receive acoustical elements and non-acoustical elements which combine with the relatively loose and open weave of the woven fabric to provide various portions of the article with selected amounts of porosity. The non-acoustical elements are generally aperture-free and in any event prevent the passage of sound waves therethrough. The acoustical elements have a selected number of apertures such as holes of selected size extending through the thickness thereof. The apertured acoustical elements combine with the adjacent, relatively loosely woven plies of the woven fabric so as to provide such portions of the woven article with a selected amount of porosity so as to pass sound waves therethrough at a controlled rate.

In a preferred embodiment of the invention a pair of rib plies of the woven fabric extend in generally zig zag fashion between the opposite faces to form a plurality of rib portions, each of which defines one of the generally planar pockets. Opposite pairs of spaced apart face plies of the woven fabric define additional planar pockets therebetween. Insertion of the acoustical and non-acoustical elements within the various pockets in the ribs and faces provides the woven article with desired acoustical properties. In addition such elements provide the woven article with substantial strength and rigidity, while at the same time minimizing the weight and expense of the article. The various acoustical and non-acoustical elements combine with the woven fabric to provide the resulting woven article with a plurality of acoustical chambers designed to receive sound waves from outside the article and to dissipate such sound waves.

In a preferred method of making a woven acoustical panel in accordance with the invention the multi-ply fabric is relatively loosely woven and is impregnated with resin. The acoustical and non-acoustical elements are next inserted into the pockets formed within the woven fabric, and where desired mandrels are inserted in open spaces formed within the woven fabric. The impregnated fabric is then cured and the mandrels are removed therefrom, providing the finished article.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
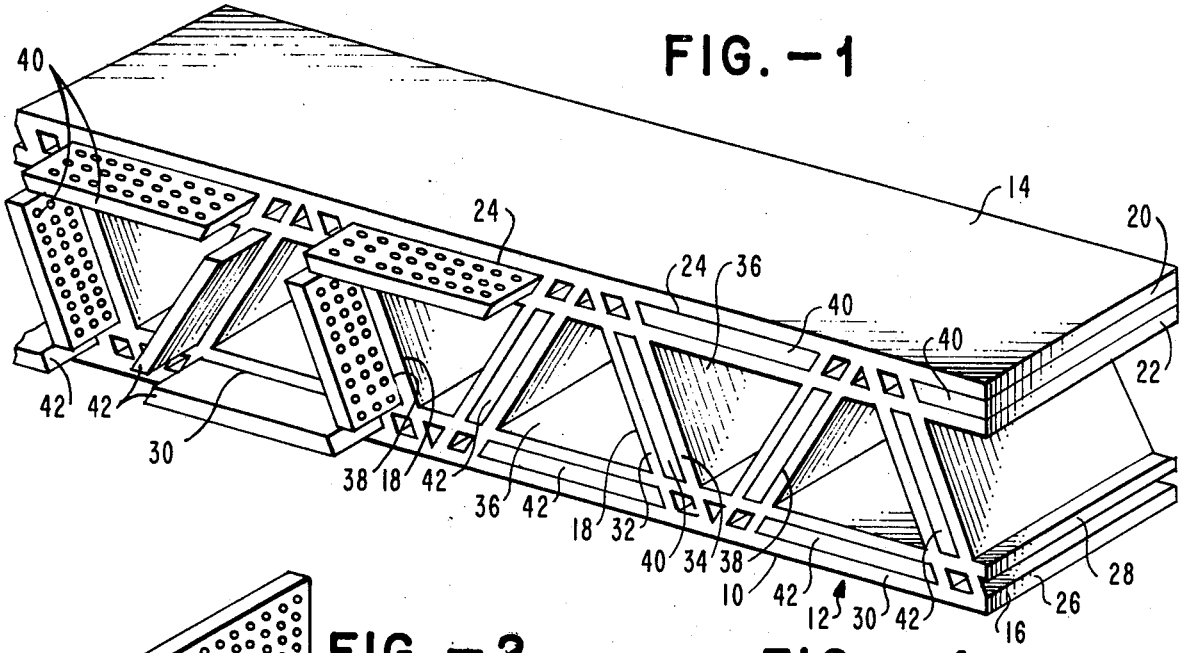
FIG. 1 is a perspective view of a multi-ply woven article in accordance with the invention illustrating the manner in which acoustical and non-acoustical elements are inserted into the article to form an acoustical panel.

FIG. 1 illustrates a woven article 10 forming an acoustical panel 12 in accordance with the invention. The article 10 includes opposite, generally planar faces 14 and 16 which are disposed in spaced-apart, generally parallel relation. A plurality of intermediate rib portions 18 extend between and couple the opposite faces 14 and 16 to form the woven article 10.

The top face 14 is comprised of a pair of generally planar, parallel, spaced-apart face plies 20 and 22 defining a plurality of generally planar pockets 24 therebetween. In like fashion the bottom face 16 is comprised of generally planar, parallel, spaced-apart face plies 26 and 28 defining a plurality of generally planar pockets 30 therebetween. The various rib portions 18 are comprised of a pair of rib plies 32 and 34 which are disposed in generally parallel, spaced-apart relation to each other and which alternately extend between the opposite faces 14 and 16 in generally zig zag fashion so as to form a plurality of open spaces 36 of generally triangular-shaped cross section with the faces 14 and 16. The portions of the rib plies 32 and 34 forming each rib portion 18 define a generally planar pocket 38 therebetween.

The rib plies 32 and 34 are interwoven with the face plies 20, 22, 26 and 28 as described in a copending application, Ser. No. 290,543, filed Sept. 20, 1972, Walter A. Rheaume and Donald M. Hatch, Multi-ply Woven Article Having Double Faces, which application is assigned to the same assignee as the present application. As described in that application the fabric is integrally woven such that the rib plies 32 and 34 are interwoven with each of the four different face plies 20, 22, 26 and 28. Also the rib plies 32 and 34 are interwoven with each other at the areas of interweaving of the rib plies with the outer face plies 20 and 26. As described in a copending application, Ser. No. 290,541, filed Sept. 20, 1972, Donald M. Hatch, Multi-ply Woven Article Having Stiffening Elements Between Double Plies, which application is assigned to the same assignee as the present application, the various generally planar pockets 24, 30 and 38 formed in a woven fabric article of this type may be filled with generally planar stiffening elements of shape and size similar to that of the pockets to provide a woven article which is relatively strong and rigid, particularly with respect to compressive forces, while at the same time being relatively lightweight and inexpensive. The woven articles described in said copending application, Ser. No. 290,541, take advantage of the face that the generally parallel rib plies form a structural truss between the opposite faces. Relatively thin, lightweight and inexpensive stiffening elements can be inserted within the pockets formed between the rib plies so as to take advantage of this effect. In similar fashion such elements may be inserted within the various pockets formed within the opposite faces so as to provide such faces with substantial strength and rigidity at the expense of only a slight increase in the overall weight and cost of the woven article.

In accordance with the present invention relatively stiff elements which are relatively thin, inexpensive and lightweight are inserted within the various pockets 24, 30 and 38 to provide the woven article 10 with substantial strength and rigidity. More importantly, however, selected ones of the inserted elements are provided with an arrangement of apertures such as holes so as to provide the woven article with highly desirable acoustical properties and enable the article to be used as an acoustical panel. Thus while the various acoustical and non-acoustical elements greatly increase the strength and rigidity of the woven article 10 they also provide the article with highly desirable acoustical properties and greatly facilitate the manufacture of such article. As described in greater detail hereafter the use of the relatively stiff elements within the woven article 10 enables the fabric comprising the article 10 to be relatively loosely woven at considerable savings in time and expense. The elements compensate for the resulting flimsiness and high porosity of the woven fabric.

As seen in FIG. 1 the relatively stiff elements which are used to fill the pockets 24, 30 and 38 comprise a plurality of generally planar acoustical elements 40 and a plurality of generally planar non-acoustical elements 42. Several of the elements 40 and 42 are shown in a state of partial insertion within their respective pockets in the lefthand portion of FIG. 1 to better illustrate the manner in which such elements are received within the various pockets of the woven article 10.

Figure 2:
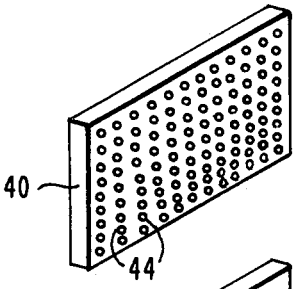
FIG. 2 is a perspective view of an acoustical element for use in the article of FIG. 1.
Figure 3:
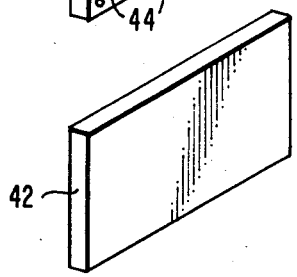
FIG. 3 is a perspective view of a non-acoustical element for use in the article of FIG. 1.

A typical acoustical element 40 is illustrated in FIG. 2, and a typical non-acoustical element 42 is illustrated in FIG. 3. In the previously referred to copending application, Ser. No. 290,541, the various stiffening elements used in the woven article disclosed therein are disclosed as comprising various combinations of like of different materials chosen for their strength, low cost, light weight and ease of preparation. The stiffening elements as so described can comprise a single layer or multiple layers of various different materials such as metals or woven and resin impregnated fabrics, and may comprise unidirectional materials having commonly directed fibers which impart great strength to the material in a single, common direction as well as materials which exhibit substatially equal strength in all directions. The corresponding acoustical and non-acoustical elements 40 and 42 of the present invention may be made of similar materials. However in the acoustical panels of the present invention strength is usually a secondary consideration with the acoustical properties of the panel being the primary consideration. Accordingly the various elements 40 and 42 of the present invention are typically made from a single layer of material which is relatively light in weight, inexpensive, and yet reasonably strong. In the case of the acoustical elements 40 the material comprising such elements must be capable of withstanding the formation of a plurality of apertures or holes 44 through the thickness thereof between the opposite sides of the element. While any appropriate materials can be used to form the elements 40 and 42, such elements are typically made of thin gauge metal, or reinforced plastic such as fiberglass. Elements made of thin gauge metal have the advantage of being relatively thin. On the other hand elements made of materials such as fiberglass, while being somewhat thicker, are typically considerably lighter than metal elements. In the case of woven articles having a panel thickness on the order of approximately ¾ inch the various acoustical and non-acoustical elements typically have a thickness on the order of 0.015–0.040 inch, depending on considerations such as the materials used.

Figure 4:
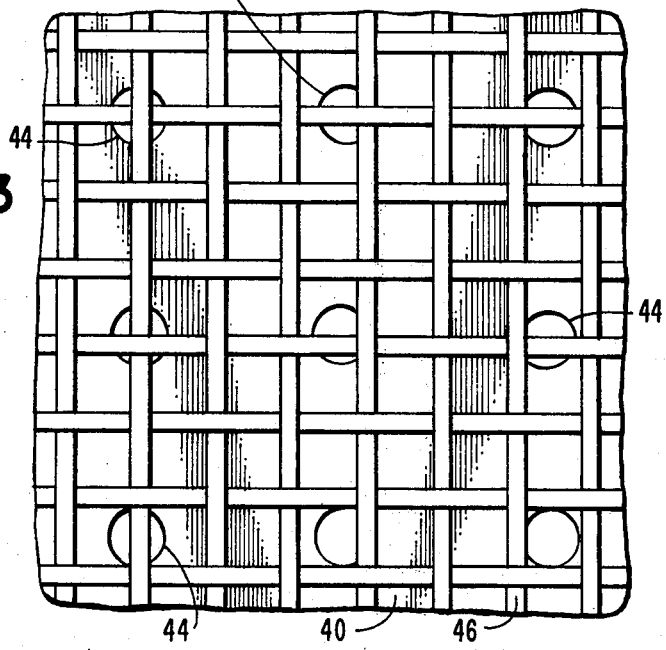
FIG. 4 is a plan view of a portion of the article of FIG. 1 illustrating the manner in which the acoustical elements combine with a relatively loosely woven fabric to provide selected porosity in accordance with the invention.

As noted above the elements 40 and 42 in accordance with the invention provide a desirable amount of acoustical porosity as well as structural strength and rigidity, enabling the woven fabric comprising the article 10 to be woven in relatively loose, open fashion so as to have a relatively low density. This is illustrated in FIG. 4 which depicts a portion of a woven fabric ply 46 and an adjacent portion of an acoustical element 40 disposed within a pocket formed by the ply 46. The woven fabric ply 46 could comprise a portion of one of the rib plies 32 and 34, in which event the acoustical element 40 would reside within one of the pockets 38. Alternatively the ply 46 could comprise a portion of one of the face plies 20, 22, 26 and 28, in which event the acoustical element 40 would reside within one of the face pockets 24 and 30.

As seen in FIG. 4 the woven fabric ply 46 has been woven using a relatively loose, open weave so as to have a porosity on the order of at least about 40%. In other words the open areas between the various yarns comprising the ply 46 comprise at least approximately 40% of the total area of the ply 46. The various holes 44 within the acoustical element 40 are arranged such that the element 40 combines with the woven fabric ply 46 and the other fabric ply on the opposite side of the element 40 (not shown) to provide the resulting combined sandwich with a selected overall porosity for acoustical purposes. Such overall porosity may be any appropriate value depending upon the acoustical requirements, but is typically on the order of 5–10 percent. In other words those portions of the holes 44 within the element 40 which are exposed to sound waves by the woven fabric plies on both sides of the element 40 desirably comprise about 5–10 percent of the total area of the acoustical element woven fabric ply combination. In panels having a thickness on the order of ¾ inch and elements of approximately 0.015–0.040 inch thickness, as previously described, porosities within this general range can be provided by holes 44 which are on the order of 0.030–0.080 inch in diameter and which are spaced apart so as to have a density on the order of 30–100 or more holes per square inch of surface area of the element 40.

It will be seen that the acoustical elements 40 combine with the adjacent portions of the relatively loosely woven plies so as to provide the corresponding portion of the woven article 10 with a desired porosity for acoustical purposes. On the other hand the non-acoustical elements 42 which as seen in FIG. 3 are generally absent any holes or aperatures so as to prevent the passage of sound waves therethrough combine with adjacent portions of the woven fabric plies to provide the corresponding portions of the woven articles with a relatively high resistance to sound waves.

Figure 5:
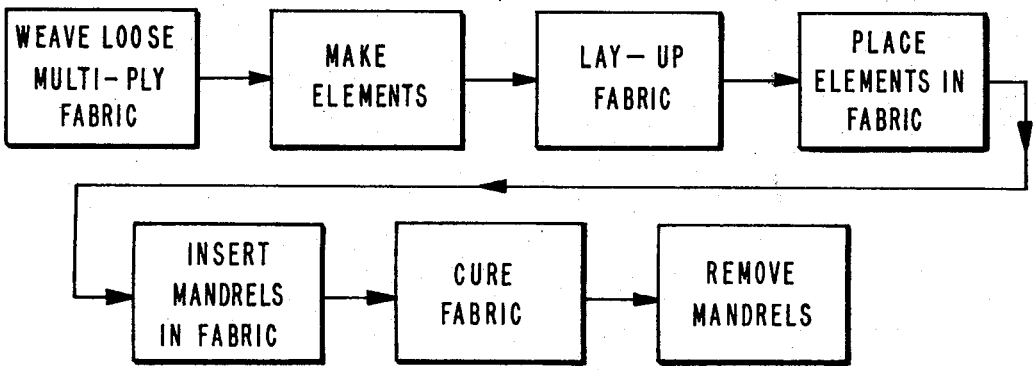
FIG. 5 is a block diagram of the various steps in a preferred method of making a woven article in accordance with the invention.

The acoustical elements 40 and the non-acoustical elements 42 can be arranged in any appropriate fashion within the various pockets of a woven article to achieve desired acoustical effects. In the particular example of FIG. 1 the woven article 10 thereof is designed so as to be mounted on its bottom face 16 and to receive the sound waves to be dissipated through its top face 14. Accordingly the various pockets 30 within the bottom face 16 are filled with the non-acoustical elements 42. At the same time the various pockets 24 of the top face 14 are provided with the acoustical elements 40 so as to permit the sound waves to pass therethrough and into the internal chambers formed by the open spaces 36. Various groups of the open spaces 36 can be divided into separate sound compartments or chambers by use of the non-acoustical elements 42 with the intervening rib pockets 38 being filled with the acoustical elements 40 to permit the sound waves to pass therethrough. In the particular example of FIG. 1 every other rib portion is provided with a non-acoustical element 42, so that each adjacent pair of the open spaces 36 defines a different sound chamber or compartment. In actual practice various alternative arrangements of the elements 40 and 42 are possible. Thus each and every rib pocket 38 can be provided with a non-acoustical element 42, in which event each open space 36 defines a different sound chamber. Alternatively the various rib pockets 38 can be filled with the acoustical elements 40, in which event the entire interior of the woven article 10 comprises a single sound chamber. The various steps involved in one preferred method of making an acoustical panel in accordance with the invention are illustrated in FIG. 5. As seen in FIG. 5 the first step is to weave the multi-ply fabric. As previously noted fabrics used in woven articles according to the invention can be woven with relatively low densities at considerable saving in time and expense. At the same time as the fabric is being woven the various elements 40 and 42 are provided. These elements can be made by fabricating or assembling the appropriate materials and by cutting such materials into the various elements 40 and 42 of appropriate size. In the case of the acoustical elements 40 the holes 44 or other apertures are drilled therein or otherwise made. The various elements 40 and 42 of FIG. 1 are shown as having beveled edges because of the various adjacent open spaces. As a practical matter however the elements 40 and 42 can typically be made so as to have right angle edges as shown in FIGS. 2 and 3. Where necessary the woven fabraic usally expands or otherwise moves or flexes so as to accommodate the elements 40 and 42.

When the woven fabric and the various elements have been provided the next step is to lay-up the fabric by impregnating it with an appropriate resin. The resin can comprise any appropirate material with polymide type resins generally being preferred because of their high heat resistance. For that matter the yarns used to weave the woven fabric can comprise any appropriate material such as fiberglass or carbon. Next the elements 40 and 42 are placed within the various pockets formed in the woven fabric, after whih the fabric is subjected to elevated temperatures and pressures to cure the resin. The various elements 40 and 42 normally provide the woven article with considerable rigidity once they are inserted in the various pockets. However, where desired the various open spaces 36 can be filled with mandrels to insure that the fabric is held erect and rigid during curing. Upon completion of the cure the mandrels are removed from the open spaces 36 to provide the finished article.

Variations in the manufacturing process for the woven article are available where economic, manufacturing or other considerations dictate. Thus the various elements 40 and 42 can be placed within the woven fabric using a release agent which permits the elements to be removed from the woven article, such as for inspection or replacement, after the article has been impregnated and cured. Where desired the various pockets within the woven fabric can be filled with mandrels during resin impregnation and curing, after which the mandrels are removed and replaced by the elements 40 and 42.

While the invention has been particularly shown and described with reference to a preferred embodiment thereof, it will be understood by those skilled in the art that the foregoing and other changes in the form and details may be made therein without departing from the spirit and scope of the invention.

What is claimed is:

1. A multi-ply woven acoustical panel comprising a woven fabric having a pair of opposite, spacedapart, generally planar faces and a plurality of intermediate ribs of generally planar configuration extending between and being interwoven with the opposite faces, the faces and the ribs defining a plurality of acoustical chambers within the panel and between the opposite faces, the planar faces and the intermediate ribs including pairs of generally planar, spaced-apart plies defining relatively thin, generally planar chambers which border the acoustical chambers, at least the pairs of generally planar, spaced-apart plies of the woven fabric being of relatively open weave construction and having at least adequate porosity to relatively free pass acoustical waves therethrough, and a plurality of relatively thin, generally planar elements of size and shape similar to and disposed within the relatively thin, generally planar chambers, the pairs of plies defining the relatively thin, generally planar chambers combining with the relatively thin, generally planar elements disposed therein to form skins bounding the acoustical chambers which have a thickness many times less than the thickness of the acoustical chambers, the relatively thin, generally planar elements providing the skins with substantial strength and rigidity and at least some of the elements being acoustically transmissive elements and having a predetermined porosity to acoustical waves which largely determines the porosity of the skins to acoustical waves when combined with the porosity of the pairs of generally planar, spaced-apart plies.

2. The invention defined in claim 1, wherein the relatively thin, generally planar elements are comprised of acoustically transmissive elements and acoustically non-transmissive elements, the acoustically transmissive elements conducting sound waves into the acoustical chambers and the acoustically nontransmissive elements preventing sound waves from exiting the acoustical chambers.

3. A multi-ply woven acoustical panel comprising a woven fabric having a pair of opposite, spaced-apart, generally planar faces, at least one of which is comprised of a pair of spaced-apart plies defining a thin, planar space therebetween, at least the pair of spaced-apart plies of the woven fabric being of relatively open weave construction and having at least adequate porosity to relatively freely pass acoustical waves therethrough, and a plurality of intermediate ribs of generally planar configuration extending between and being interwoven with the opposite faces, the intermediate ribs being interwoven with each of the pair of spaced-apart plies to divide the thin, planar space into a plurality of thin, planar chambers spaced-apart along the length of the panel, the intermediate ribs dividing the space between the opposite faces into a plurality of acoustical chambers spaced-apart along the length of the panel, and a thin, planar element having a size and shape similar to and disposed within each of the thin, planar chambers, the pair of spaced-apart plies combining with the thin, planar elements to form skins bounding the acoustical chambers which have a thickness many times less than the thickness of the acoustical chambers, the thin, planar elements providing the skins with substantial strength and rigidity and at least some of the elements being acoustically transmissive elements and having a predetermined porosity to acoustical waves which largely determines the porosity of the skins to acoustical waves when combined with the porosity of the pair of spaced-apart plies.

4. A multi-ply woven acoustical panel comprising a woven fabric having a pair of opposite, spacedapart, generally planar faces, and a plurality of intermediate ribs of generally planar configuration extending between and being interwoven with the opposite faces, each of the ribs being comprised of a pair of plies which are both interwoven with each of the faces and with each other at the faces and which extend in parallel, spaced-apart relation between the opposite faces to define a plurality of relatively thin, generally planar chambers extending between the opposite faces in a zig zag configuration, the pair of plies being of relatively open weave construction and having at least adequate porosity to relatively freely pass acoustical waves therethrough, the ribs dividing the interior space of the panel between the opposite faces into a plurality of acoustical chambers of triangular shaped cross-section with each adjacent pair of the acoustical chambers being separated by a different one of the relatively thin, generally planar chambers, and a thin, planar element having a size and shape similar to and disposed within each of the thin, planar chambers, the pair of plies combining with the thin, planar elements to form skins separating adjacent pairs of the acoustical chambers which have a thickness many times less than the thickness of the acoustical chambers, the thin, planar elements providing the skins with substantial strength and rigidity and at least some of the elements being acoustically transmissive elements and having a predetermined porosity to acoustical waves which largely determines the porosity of the skins to acoustical waves when combined with the porosity of the pair of plies.

5. A multi-ply woven acoustical panel comprising a woven fabric of relatively open weave construction having at least adequate porosity to relatively freely pass acoustical waves therethrough, the woven fabric having a pair of opposite, spaced-apart, generally planar faces, at least one of which is comprised of a pair of spaced-apart plies defining a thin, planar space therebetween, and a plurality of intermediate ribs of generally planar configuration extending between and being interwoven with the opposite faces to divide the thin, planar space into a first plurality of thin, planar chambers spaced-apart along the length of the panel, each of the ribs being comprised of a pair of plies which are both interwoven with each of the faces including each of the pair of plies comprising said at least one face and with each other at the faces and which extend in parallel, spaced-apart relation between the opposite faces to define a second plurality of relatively thin, generally planar chambers extending between the opposite faces, the ribs dividing the interior space of the panel between the opposite faces into a plurality of acoustical chambers with each adjacent pair of the acoustical chambers being bounded by a different one of the second plurality of thin, planar chambers, at least some of the acoustical chambers being bounded on one side by a different one of the first plurality of thin, planar chambers, and a second plurality of thin, planar elements having a size and shape similar to and disposed within each of the second plurality of thin, planar chambers, the pair of spaced-apart plies forming the first plurality of thin, planar chambers combining with the first plurality of thin, planar elements to form skins bounding the acoustical chambers and the pair of plies forming the second plurality of thin, planar chambers combining with the second plurality of thin, planar elements to form skins bounding the acoustical chambers, said skins having a thickness many times less than the thickness of the acoustical chambers, the first and second pluralities of thin, planar elements providing the skins with substantial strength and rigidity and at least some of the thin, planar elements being acoustically transmissive elements and having a predetermined porosity to acoustical waves which largely determines the porosity of the skins to acoustical waves when combined with the porosity of the pairs of plies.

6. The invention defined in claim 5, wherein the intermediate ribs extend between the opposite faces in zig zag fashion to provide the acoustical chambers with generally triangular shaped cross-sections.

* * * * *

UNITED STATES PATENT OFFICE

CERTIFICATE OF CORRECTION

Patent No. 3,966,013 Dated June 29, 1976

Inventor(s) Donald M. Hatch and George D. Lee

It is certified that error appears in the above-identified patent and that said Letters Patent are hereby corrected as shown below:

Column 1, line 52, after "single", "piles" should read --plies--. Column 5, line 1, after "like", "of" (second occurrence) should read --or--; line 10, "substatially" should read --substantially--. Column 7, line 4, "fabraic" should read --fabric--; line 16, after "after", "whih" should read --which--; line 46, "spacedapart" should read --spaced-apart--; line 58, after "relatively", "free" should read --freely--. Column 8, line 12, "nontransmissive" should read --non-transmissive--. Column 10, line 6, after "chambers", insert --a first plurality of thin, planar elements having a size and shape similar to and disposed within each of the first plurality of thin, planar chambers,--.

Signed and Sealed this

Twelfth Day of October 1976

[SEAL]

*Attest:*

RUTH C. MASON
*Attesting Officer*

C. MARSHALL DANN
*Commissioner of Patents and Trademarks*